US006527615B1

(12) United States Patent
Boehler

(10) Patent No.: US 6,527,615 B1
(45) Date of Patent: Mar. 4, 2003

(54) BALLOON CLOSURE DEVICE

(76) Inventor: Ray Boehler, P.O. Box 1, Group 8, R.R. 2, Dugald, Manitoba (CA), R0E 0K0

( * ) Notice: Subject to any disclaimer, the term of this patent is extended or adjusted under 35 U.S.C. 154(b) by 0 days.

(21) Appl. No.: 10/046,691

(22) Filed: Jan. 16, 2002

(51) Int. Cl.[7] ..... A63H 3/06
(52) U.S. Cl. ..... 446/220; 24/30.5 R; 446/222
(58) Field of Search ..... 446/220–226; 40/212, 214; 24/30.5, 30.5 S, 30.5 R, 30.5 P

(56) References Cited

U.S. PATENT DOCUMENTS

| | | | | |
|---|---|---|---|---|
| 1,201,045 A | * | 10/1916 | Head | |
| 1,631,205 A | | 6/1927 | Horner et al. | |
| 4,857,029 A | | 8/1989 | Dierick et al. | |
| 4,936,532 A | | 6/1990 | Williams | |
| 5,040,903 A | | 8/1991 | Schramer | |
| 5,301,392 A | * | 4/1994 | Richman | 24/30.5 R |
| 5,551,127 A | * | 9/1996 | May | 24/30.5 R |
| 5,628,091 A | | 5/1997 | Mueller | |
| 5,799,377 A | | 9/1998 | Carroll et al. | |
| 6,007,403 A | * | 12/1999 | Urspringer et al. | 446/222 |
| 6,058,572 A | * | 5/2000 | Folkmar | 24/30.5 R |

FOREIGN PATENT DOCUMENTS

| | | | | |
|---|---|---|---|---|
| DE | 638631 | * | 11/1936 | 446/220 |
| DE | 3231917 | * | 3/1984 | 446/222 |
| EP | 105179 | * | 4/1984 | 446/222 |
| EP | 623371 | * | 11/1994 | 446/220 |
| GB | 300255 | * | 4/1929 | 446/220 |
| GB | 661644 | * | 11/1951 | 446/223 |

* cited by examiner

*Primary Examiner*—Derris H. Banks
*Assistant Examiner*—Jamila O. Williams
(74) *Attorney, Agent, or Firm*—Donald R. Schoonover

(57) ABSTRACT

A balloon mechanism includes a closure that is one-piece and monolithic with a balloon neck. One form of the closure includes a snap closure, and another form of the closure includes a strap.

8 Claims, 3 Drawing Sheets

BALLOON CLOSURE DEVICE

BACKGROUND OF THE INVENTION

1. Field of the Invention

The present invention relates to the general art of closure devices, and to the particular field of closure devices for balloons.

2. Discussion of the Related Art

Nearly everyone has had the experience of having a balloon deflate, sometimes nearly before their eyes. While this is usually not at all disturbing, it can be unnerving for small children. This problem often occurs if a balloon has not been fully sealed. The gas pressure inside the balloon quickly forces gas out of the balloon, usually through the neck of the balloon.

Accordingly, there is a need for a device that can fully seal an inflated balloon.

While the art contains devices intended to seal balloons, many of these devices are cumbersome to use and thus not easily used by young children. Thus, if a youngster has a balloon that has become deflated that youngster may not be able to re-inflate the balloon. In essence, the balloon will be lost to that youngster. Even if re-inflation means merely using lung power to drive air into the balloon, if the youngster does not have sufficient manual dexterity to tie the neck of the balloon, the balloon will be lost to the youngster.

Therefore, there is a need for a device which does not require a great deal of manual dexterity to close off a filled balloon.

Still further, if there is an occasion that includes a multiplicity of balloons, one or more people may be inundated with filling and/or re-filling balloons. If balloon filling and/or re-filling is cumbersome, this task may become onerous, and possibly overwhelming. Accordingly, many balloons may not be filled, while many more may not be re-filled.

In some cases, a person charged with the duty of filling and/or re-filling balloons has their manual dexterity impaired. Often tying off filled balloons requires more manual dexterity than the person possesses. An instance of this is when such a person is a young child at a party.

Thus, there is a need for a device which makes filing or re-filling a balloon as expeditious as possible.

While the art contains devices intended to assist tying off a balloon, most of these devices require a fairly high degree of manual dexterity. As can be understood from the foregoing, a requirement of a high degree of manual dexterity may prevent some people, such as young children, from performing the task of filling and/or re-filling a balloon.

Therefore, there is a need for a device for tying off a filled balloon which does not require a great deal of manual dexterity.

Still further, many known devices used to close a filled balloon are separate entities from the balloons. That is, a special balloon filling and tying device is provided separate from the supply of balloons. While effective, these devices, also, have drawbacks. For example, the device must be obtained separately from the balloons which adds another step that must be carried out by a person planning a party or the like. Still further, the device may be lost or not delivered to a party site, which makes the device useless. Still further, a separate device is simply another element that must be learned. While these drawbacks may not sound onerous, they can be if the person in charge of balloons is a young child.

Therefore, there is a need for a device for tying filled balloons that is unitary with a balloon.

PRINCIPAL OBJECTS OF THE INVENTION

It is a principal object of the present invention to provide a device that permits a person to expeditiously tie off a filled balloon.

It is another object of the present invention to provide a device that can fully seal an inflated balloon.

It is another object of the present invention to provide a device which does not require a great deal of manual dexterity to close off a filled balloon.

It is another object of the present invention to provide a device which makes filing or re-filling a balloon as expeditious as possible.

It is another object of the present invention to provide a device for tying filled balloons that is unitary with a balloon.

SUMMARY OF THE INVENTION

These, and other, objects are achieved by a balloon closure device that is one-piece with the balloon body and is easily manipulated to close or re-close the balloon. The device includes a snap action element that is one-piece with the balloon so the device is easily snapped closed to close the balloon. Another form of the device includes a closure strap that is also one-piece with the balloon.

DETAILED DESCRIPTION OF THE INVENTION

Figure 1:
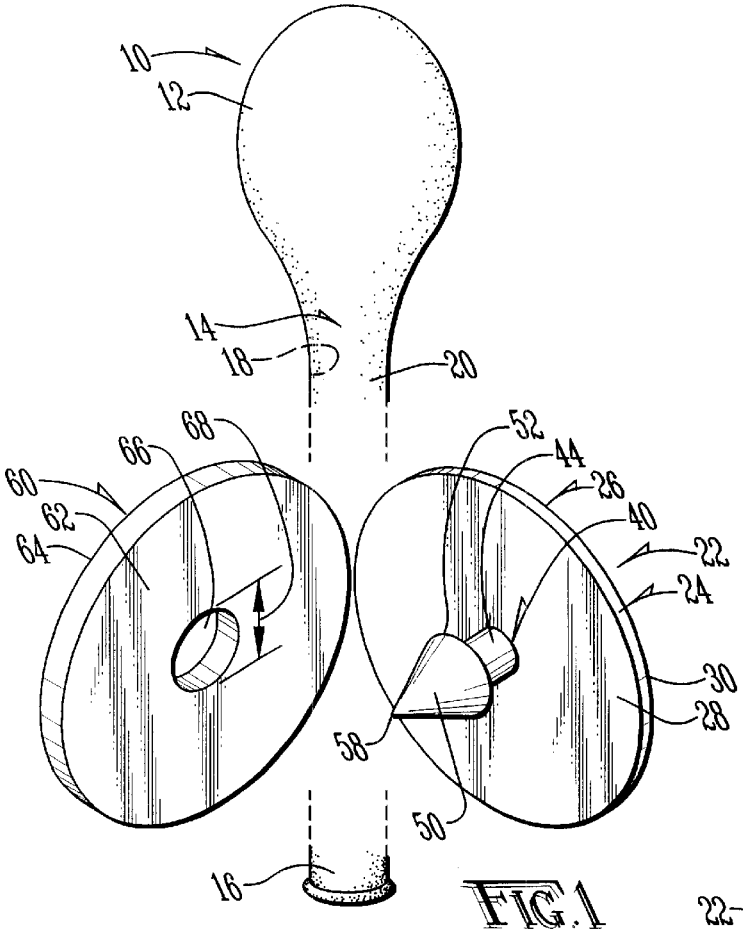
FIG. 1 is a perspective view of a snap closure device for effective one-piece connection with a balloon in accordance with the teaching of the present invention.
Figure 2:
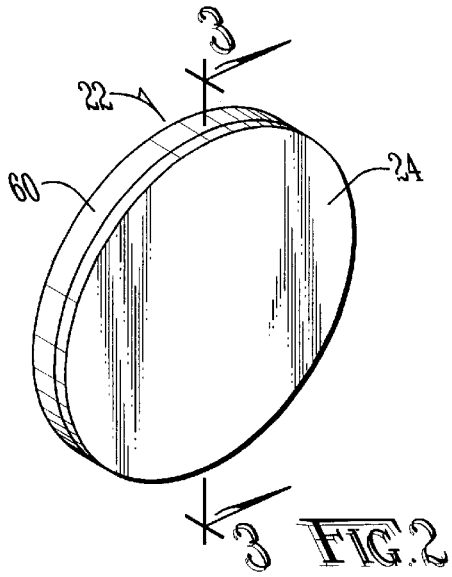
FIG. 2 is a perspective view of the snap closure device in a closed configuration.
Figure 3:
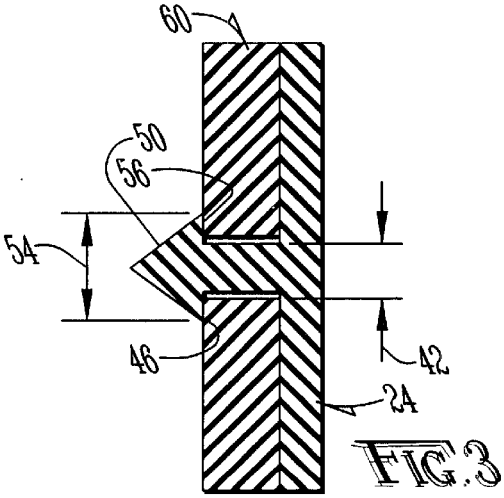
FIG. 3 is a cross-sectional view of the snap closure device in the closed configuration, taken along line 3—3 of FIG. 2.

Other objects, features and advantages of the invention will become apparent from a consideration of the following detailed description and the accompanying drawings.

The device of the present invention is one-piece with a balloon and is easily and quickly used even by a person having limited manual dexterity.

Referring to the Figures, it will be seen that the present invention is embodied in a balloon 10 which comprises: a one-piece monolithic body 12 which includes a neck 14 having a mouth 16 on one end thereof. Neck 14 is shown in partial dotted lines for a purpose that will be understood from the following disclosure. Neck 14 further includes an inside surface 18 and an outside surface 20. Balloon 10 is commonly formed of a rubber-like or plastics type material and the one-piece monolithic nature thereof permits that balloon to retain most gases used to inflate balloons, including air and helium.

Also shown in the figures is a closure device or member 22 that is one-piece with neck 14 of one-piece monolithic body 12 so that closure member 22 remains with the balloon 10 at all times. Closure member 22 includes a stud member 24 which is located on neck 14 of one-piece monolithic body 12. Stud member 24 includes a base 26 which is generally arcuate and which has one surface, either inside surface 28 or outside surface 30, that is one-piece and integral with neck 14 of one-piece monolithic body 12 and a second surface, either inside surface 28 or outside surface 30, presented away from the other surface of stud member 24 of said closure member 22.

Closure member 22 is formed of flexible material such as a plastics-type material or rubberlike material and further includes a prong member 40 having an outer dimension 42 as indicated in FIG. 1, a base end 44 which is one-piece with the base of stud member 24, and a distal end 46 spaced from base end 44 of prong member 40.

A conical head 50 is one-piece with distal end 46 of prong member 40. Conical head 50 includes an arcuate base portion 52 that has an outer dimension 54 that is greater than outer dimension 42 of prong member 40 with a shoulder 56 being defined at the intersection of base end 44 of prong member 40 and arcuate base portion 52 of conical head 50. Conical head 50 includes an apex 58 spaced apart from base portion 52 of the conical head 50.

Closure member 22 further includes a socket member 60 having one surface, either first surface 62 or second surface 64, thereof integral and one-piece with neck 14 of one-piece monolithic body 12 and is located to be adjacent to prong member 40 when the closure member is mounted on the balloon 10. Socket member 60 further includes a prong member receiving hole 66 defined through socket member 60 and has a dimension 68 smaller than outer dimension 54 of arcuate base 52 of conical head 50 so head 50 and socket member 60 must flex to permit head 50 to pass through hole 66, after which, the socket member 60 flexes back to snap behind shoulder 56 and lock socket member 60 to prong 40. It is to be understood that the relative magnitudes of dimensions 54 and 68 are such that the elastic limit of the material used to form socket member 60 is not exceeded.

As will be understood from the teaching of this disclosure, since closure member 22 is positioned on the surfaces of neck 14, at least a portion of neck 14 of one-piece monolithic body 12 adjacent to socket member 60 will be interposed between shoulder 56 and stud member 24 after conical head 50 has been forced through prong member receiving hole 66 to close closure member 22 and close neck 14 of one-piece monolithic body 12.

As can be understood from this disclosure, the closing of neck 14 is achieved by a simple snap action between two elements that are one-piece with the body 12. The snap action is tight enough to prevent gas from leaking out of the balloon 10 via the neck 14 of the balloon 10. Should the balloon 10 need re-inflation, the closure member 22 is simply opened by pulling head 50 back through hole 66, re-inflating the balloon, and then re-snapping the closure member 22.

Figure 5A:
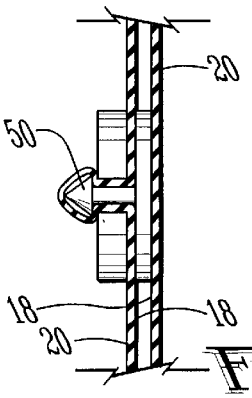
FIGS. 5 and 5A illustrate operation of one form of the device of the present invention.
Figure 5:
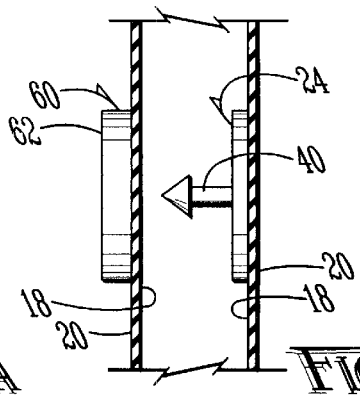

Referring to FIGS. 5A–8A, various placements of closure member on the surfaces of neck 14 are shown. As shown in FIGS. 5 and 5A, stud member 24 is mounted on inside surface 18 of neck 14 while socket member 60 is mounted on outside surface 20 of neck 14. As can be understood from FIG. 5A, once the stud member 24 and the socket member 60 are snapped together, neck 14 will be forced through hole 66 of socket member 60 and the neck 14 will be sealed shut.

Figure 6A:
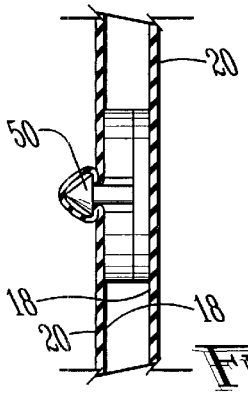
FIGS. 6 and 6A illustrate operation of another form of the device of the present invention.
Figure 6:
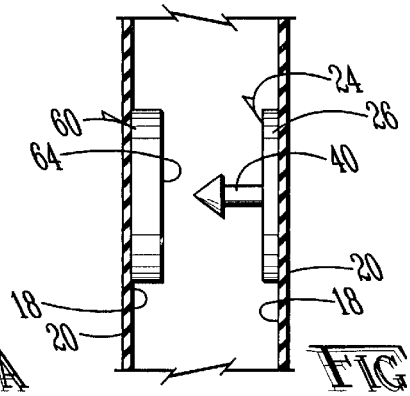
Figure 7A:
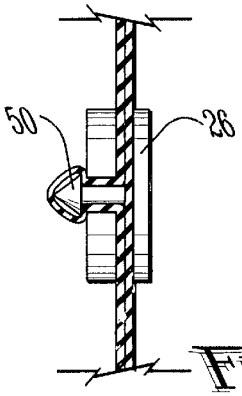
FIGS. 7 and 7A illustrate operation of another form of the device of the present invention.
Figure 7:
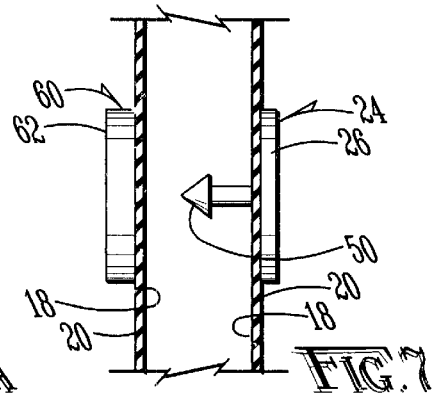
Figure 8A:
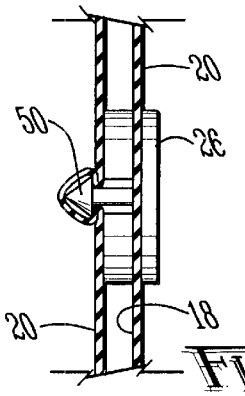
FIGS. 8 and 8A illustrate operation of another form of the device of the present invention
Figure 8:
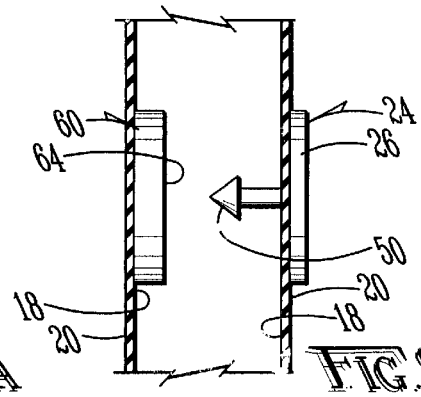

Similar action, in which neck 14 is forced through socket member 60 by prong member 40 is indicated in FIGS. 6 and 6A as well as in FIGS. 7 and 7A, with both stud member 24 and socket member 60 being mounted on inside surface 18 of neck 14 in FIGS. 6 and 6A, and with stud member 24 and socket member 60 being mounted on outside surface 20 of neck 14 in FIGS. 7 and 7A. In FIGS. 7 and 7A, prong member 40 drives neck 14 through hole 66 to lock the neck 14 together in a sealed relationship. Yet another alternative arrangement is shown in FIGS. 8 and 8A in which both stud member 24 and socket member 60 are mounted on inside surface 18 of neck 14. This arrangement seals neck 14 due to the resiliency of neck 14 which will snap around conical head 50 as it emerges from hole 66 and interposes itself between shoulder 56 and socket member 60 with socket member 60 being tightly drawn against inside surface 18 of neck 14 adjacent to stud member 40 to seal neck 14. Each of the arrangements forces neck 14 tightly closed but can be re-opened by pulling head 50 back through hole 66 to re-fill a balloon.

Figure 4:
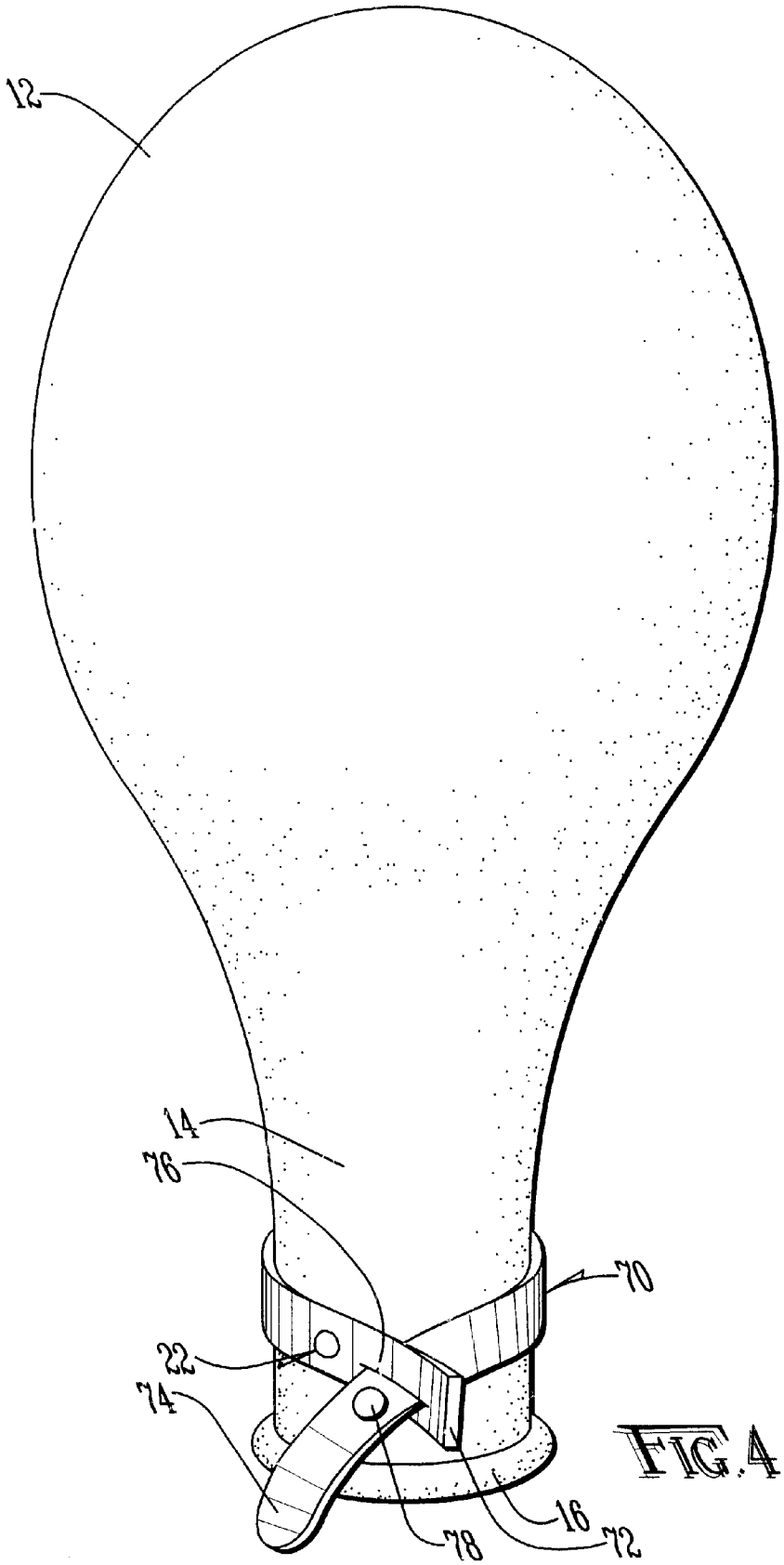
FIG. 4 is a perspective view of another form of the balloon closure device of the present invention.

Another form of the invention is shown in FIG. 4 and includes a strap 70 that is one-piece with neck 14 of body 12 of a balloon. A closure member 22 is shown with strap 70 functioning as socket member 60 with a hole defined therethrough so a prong can fit through the hole as above discussed. Strap 70 includes two terminal ends, 72 and 74, with a slit 76 being defined through strap 70 near end 72 and end 74 being pulled through slit 76 and pulled tight to close neck 14 of the balloon. A small protuberance 78 is located on strap 70 near end 74. Strap 70 is formed of flexible material, such as rubber, plastic, or the like. As end 74 is pulled through slit 76, the slit flexes to permit protuberance 78 to pass through slit 76. However, some force must be exerted on strap 70 to pull it back out of slit 76 and especially to pull protuberance 78 back past slit 76. This force is in excess of any force that would generally be exerted on strap 70 by the gas pressure in the balloon. Thus, once strap 70 is pulled tight against neck 14 with end 74 pulled through slit 76 far enough to pull protuberance 78 through slit 76, the strap is congigured to not loosen enough to release gas from the balloon. As discussed above, since strap 70 is one-piece with body 12, all of the above-discussed advantages are realized. Friction between end 74 and end 72 adjacent to slit 76 keeps strap 70 closed tightly enough so gas pressure in the balloon does not exert sufficient pressure on the closed strap to open that strap up, especially if protuberance 78 abuts strap end 72 after passing through the slit 76 and establishing a position on the side of the slit 76 that is associated with closing neck 14.

As can be understood from the foregoing, a balloon which includes a snap closure is first inflated, and then has the prong member 40 of the stud member 24 forced through the prong receiving hole 66 of the socket member 60 to close the neck 14 of the balloon. If re-inflation is desired, the prong member 40 is pulled back through the hole 66 and the neck 14 opened, gas re-inserted into the balloon and the closure member 22 re-set. If the strap 70 is used, the strap 70 is closed by pulling one end of the strap through the slit 76 near the other end of the strap 70 until the protuberance 78 passes through the slit 76.

It is understood that while certain forms of the present invention have been illustrated and described herein, it is not to be limited to the specific forms or arrangements of parts described and shown.

I claim:

1. A balloon mechanism comprising:

a) a one-piece monolithic body having a neck portion, an open mouth on one end of said neck portion, and a balloon body on the other end of said neck portion;

b) a closure element on said neck portion of said one-piece monolithic body, said closure element being one-piece with said one-piece monolithic body and including (1) a base having a conical prong extending therefrom with said prong having a body element having a base and a conical head having an arcuate base portion, (2) a closure element cap having a body and a prong-receiving hole defined through said body of said closure element cap; and c) said neck of said one-piece monolithic body being interposed between at least a portion of said base of said closure element and said closure element cap, said closure element being closed when said body element of said prong is received through said prong-receiving hole of said closure element cap and said conical head of said prong is in abutting contact with said body of said closure element cap.

2. A method of sealing a balloon comprising:

a) providing a balloon having a one-piece monolithic body with a neck portion, an open mouth on one end of said neck portion, and a balloon body on the other end of said neck portion; a closure element on said neck portion of said one-piece monolithic body, said closure element being one-piece with said one-piece monolithic body and including a base having a conical prong extending therefrom with the prong having a body element having a base and a conical head having an arcuate base portion, a closure element cap having a body and a prong-receiving hole defined through the body of said closure element cap, and the neck of said one-piece monolithic body being interposed between at least a portion of said base of said closure element and said closure element cap, said closure element assuming a closed configuration as said body element of said prong is received through said prong-receiving hole of said closure element cap and said conical head of said prong is in abutting contact with said body of said closure element cap;

b) inflating said one-piece monolithic body;

c) capturing said neck portion of said one-piece monolithic body between said base of said closure element and said closure element cap;

d) pressing said conical head of said prong through said prong-receiving hole of said closure element cap;

e) forcing said neck of said one-piece monolithic body through said prong-receiving hole of said closure element cap; and f) capturing said head element of said prong in abutting contact with said body of said closure element cap with at least a portion of said neck of the one-piece monolithic body interposed between said conical head of said prong and said body of said closure element cap.

3. The method as described in claim 2 further including a step of pulling said conical prong out of said prong-receiving hole and releasing said head element from said closure element cap.

4. A balloon mechanism comprising:

a) a one-piece monolithic body that includes a neck having a mouth on one end thereof, an inside surface, and an outside surface;

b) a closure member that is one-piece with said neck of said one-piece monolithic body and includes (1) a stud member on said neck of said one-piece monolithic body, said said stud member including a base having one surface one-piece and integral with said neck of said one-piece monolithic body and a second surface presented away from said surface of said stud member of said closure member, (2) a prong member having an outer dimension, a base end that is one-piece with said base of said stud member, and a distal end spaced from said base end of said prong member, (3) a conical head that is one-piece with said distal end of said prong member, said conical head including an arcuate base portion that has an outer dimension that is greater than the outer dimension of said prong member with a shoulder being defined at the intersection of said arcuate base portion of said conical head and said base portion of said prong member, and an apex spaced apart from said base portion of said conical head, (4) a socket member having one surface thereof integral and one-piece with said neck of said one-piece monolithic body and being located to be adjacent to said prong member, (5) a prong member receiving hole defined through said socket member and having a dimension smaller than said outer dimension of said arcuate base of said conical head, and (6) said conical head of said prong member and said socket member being formed of flexible material such that said conical head of said prong member and said socket member flex when said conical head of said prong member is forced through said prong member receiving hole defined through said socket member, at least a portion of said neck of said one-piece monolithic body adjacent to said socket member being interposed between a shoulder defined at the intersection of said prong member and said arcuate base of said conical head and said stud member after said conical head of said prong member has been forced through said prong member receiving hole defined through said socket member to close said closure member and to close said neck of said one-piece monolithic body.

5. The balloon mechanism as described in claim 4 wherein said base end of said prong member is located on said inside surface of said one-piece monolithic body.

6. The balloon mechanism as described in claim 4 wherein said base end of said prong member is located on said outside surface of said one-piece monolithic body.

7. The balloon mechanism as described in claim 4 wherein said one surface of said socket member is located on said inside surface of said one-piece monolithic body.

8. The balloon mechanism as described in claim 4 wherein said one surface of said socket member is located on said outside surface of said one-piece monolithic body.

* * * * *